US010267208B2

(12) United States Patent
Kudo et al.

(10) Patent No.: US 10,267,208 B2
(45) Date of Patent: Apr. 23, 2019

(54) COOLING STRUCTURE OF INTERNAL COMBUSTION ENGINE

(71) Applicant: TOYOTA JIDOSHA KABUSHIKI KAISHA, Toyota-shi (JP)

(72) Inventors: Masahito Kudo, Toyota (JP); Takashi Matsutani, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 95 days.

(21) Appl. No.: 15/329,885

(22) PCT Filed: Jul. 23, 2015

(86) PCT No.: PCT/IB2015/001228
§ 371 (c)(1),
(2) Date: Jan. 27, 2017

(87) PCT Pub. No.: WO2016/016702
PCT Pub. Date: Feb. 4, 2016

(65) Prior Publication Data

US 2017/0248064 A1 Aug. 31, 2017

(30) Foreign Application Priority Data

Jul. 28, 2014 (JP) ..... 2014-152945

(51) Int. Cl.

| | |
|---|---|
| ***F01P 3/02*** | (2006.01) |
| ***F02F 1/24*** | (2006.01) |
| ***F02B 77/08*** | (2006.01) |
| ***F01P 11/16*** | (2006.01) |

(Continued)

(52) U.S. Cl.
CPC ..... *F01P 3/02* (2013.01); *F01P 3/12* (2013.01); *F01P 11/16* (2013.01); *F02B 77/089* (2013.01);

(Continued)

(58) Field of Classification Search
CPC ..... F01P 11/16; F01P 3/02; F01P 3/12; F01P 2003/024; F01P 2060/16; F02B 77/089; F02F 1/14; F02F 1/243; F02F 1/40

(Continued)

(56) References Cited

U.S. PATENT DOCUMENTS 7,367,294 B2 * 5/2008 Rozario ..... F02F 1/4264 123/193.5
7,748,211 B2 * 7/2010 Norris ..... F01D 25/12 416/95

(Continued)

FOREIGN PATENT DOCUMENTS

CN 103775234 A 5/2014
JP 2005-188352 A 7/2005

(Continued)

OTHER PUBLICATIONS

International Search Report dated Nov. 4, 2015, in PCT/IB2015/001228 filed Jul. 23, 2015.

*Primary Examiner* — Audrey K Bradley
*Assistant Examiner* — Dapinder Singh
(74) *Attorney, Agent, or Firm* — Oblon, McClelland, Maier & Neustadt, L.L.P.

(57) ABSTRACT

A cooling structure of an engine includes a cylinder head and a coolant temperature sensor. The cylinder head gas a first water jacket for cooling a combustion chamber and a second water jacket for cooling an exhaust manifold. The cylinder head includes a joining portion where coolants from the first water jacket and the second water jacket join together. The joining portion has a first coolant passage. A second coolant passage is disposed downstream of the joining portion. The temperature sensing portion is disposed in the second coolant passage. A coolant outlet of the second water jacket is defined in the first coolant passage, and is located at a position on the cylinder head cover attachment surface side (Continued)

in the first coolant passage. The temperature sensing portion is located at a position on the cylinder block attachment surface side in the second coolant passage.

5 Claims, 5 Drawing Sheets

(51) Int. Cl.
*F02F 1/40* (2006.01)
*F01P 3/12* (2006.01)
*F02F 1/14* (2006.01)
*F02F 1/42* (2006.01)

(52) U.S. Cl.
CPC ..... *F02F 1/14* (2013.01); *F02F 1/243* (2013.01); *F02F 1/40* (2013.01); *F01P 2003/024* (2013.01); *F01P 2060/16* (2013.01); *F02F 2001/4278* (2013.01)

(58) Field of Classification Search
USPC ..... 60/320, 321
See application file for complete search history.

(56) References Cited

U.S. PATENT DOCUMENTS 9,784,175 B2 * 10/2017 Kanefsky ..... F01P 11/0285
2008/0308050 A1 * 12/2008 Kuhlbach ..... F02F 1/243 123/41.82 R
2010/0224144 A1 * 9/2010 Lopez-Crevillen ..... F02F 1/40 123/41.82 R
2010/0242869 A1 * 9/2010 Knollmayr ..... F01P 3/02 123/41.82 R
2010/0251703 A1 * 10/2010 Takeishi ..... F01N 5/02 60/320
2012/0227686 A1 9/2012 D'Anna et al.
2012/0312257 A1 12/2012 Beyer et al.
2013/0055971 A1 3/2013 Brewer et al.

FOREIGN PATENT DOCUMENTS

JP 2012-241557 A 12/2012
JP 2016-31032 A 3/2016

* cited by examiner

COOLING STRUCTURE OF INTERNAL COMBUSTION ENGINE

BACKGROUND OF THE INVENTION

1. Field of the Invention

The invention relates to a cooling structure of an internal combustion engine.

2. Description of Related Art

Japanese Patent Application Publication No. 2005-188352 (JP 2005-188352 A) describes an internal combustion engine including a cylinder head and an exhaust manifold that are formed integrally with each other. The cylinder head has a water jacket used to cool combustion chambers and a water jacket used to cool the exhaust manifold.

SUMMARY OF THE INVENTION

The above-described cylinder head may have a joining portion in which the coolant discharged from the water jacket for the combustion chambers and the coolant discharged from the water jacket for the exhaust manifold join together, and may be provided with a coolant temperature sensor disposed downstream of the joining portion to detect a coolant temperature.

The coolant temperature is a parameter used as a substitute for an engine temperature in various kinds of controls of the engine. The temperature of the coolant after the coolant cools the combustion chambers is used as a substitute for the engine temperature.

The temperature of a coolant that has cooled the exhaust manifold is usually higher than the temperature of a coolant that has cooled the combustion chambers. When the temperature of the coolant that has cooled the exhaust manifold and the temperature of the coolant that has cooled the combustion chambers differ from each other, the coolants that differ in coolant temperature from each other flow into the joining portion. As a result, the coolant temperature distribution at a position downstream of the joint portion becomes non-homogeneous.

In the state where the temperature distribution is non-homogeneous, when the coolant temperature sensor detects the temperature of the coolant that has cooled the exhaust manifold instead of the temperature of the coolant that has cooled the combustion chambers, the detected coolant temperature does not appropriately reflect the engine temperature. In this case, the detected coolant temperature may be an inappropriate value as a substitute for the engine temperature.

If mixing of the coolant discharged from the water jacket for cooling the combustion chambers and the coolant discharged from the water jacket for cooling the exhaust manifold proceeds on the downstream side of the joining portion, the temperature distribution gradually becomes homogeneous. However, the temperature of the mixed coolant is influenced by the temperature of the coolant that has cooled the exhaust manifold. Thus, if the coolant temperature sensor detects the temperature of the mixed coolant, the detected coolant temperature differs from the temperature of the coolant that has cooled the combustion chambers. Thus, in this case as well, the coolant temperature detected by the coolant temperature sensor may be an inappropriate value as a substitute for the engine temperature.

The invention provides a cooling structure of an internal combustion engine, configured to make it possible to detect an appropriate coolant temperature that reflects an engine temperature.

An aspect of the invention relates to a cooling structure of an internal combustion engine. The cooling structure includes a cylinder head and a coolant temperature sensor. The coolant temperature sensor includes a temperature sensing portion. The cylinder head has a cylinder block attachment surface and a cylinder head cover attachment surface. The cylinder head includes an exhaust manifold. The cylinder head has a first water jacket through which a coolant for cooling a combustion chamber flows and a second water jacket through which a coolant for cooling the exhaust manifold flows. The first water jacket and the second water jacket are defined within the cylinder head. The cylinder head includes a joining portion in which the coolant discharged from the first water jacket and the coolant discharged from the second water jacket join together. The joining portion has a first coolant passage. A second coolant passage is disposed at a position downstream of the joining portion. The temperature sensing portion is disposed in the second coolant passage. A coolant outlet of the second water jacket is defined in the first coolant passage, and the coolant outlet of the second water jacket is located at a position on the cylinder head cover attachment surface side in the first coolant passage. The temperature sensing portion is located at a position on the cylinder block attachment surface side in the second coolant passage.

With the foregoing configuration, the coolant discharged from the first water jacket and the coolant discharged from the second water jacket flow into the second coolant passage provided with the temperature sensing portion, through the first coolant passage.

The coolant outlet of the second water jacket is located at a position on the cylinder head cover attachment surface side in the first coolant passage. Thus, the major portion of the coolant discharged from the second water jacket flows more reliably through a space on the cylinder head cover attachment surface side in the first coolant passage and a space on the cylinder head cover attachment surface in the second coolant passage located downstream of the joining portion. As a result, in the first coolant passage and the second coolant passage, mixing of the coolant discharged from the second water jacket and the coolant discharged from the first water jacket is inhibited. The mixing of the coolants is inhibited as described above, and thus the major portion of the coolant discharged from the first water jacket flows through a space on the cylinder block attachment surface side in the first coolant passage and a space on the cylinder block attachment surface side in the second coolant passage Note that, the cylinder block attachment surface side is located on the opposite side of the central axis of each of the first coolant passage and the second coolant passage from the cylinder head cover attachment surface side.

The temperature sensing portion of the coolant temperature sensor is disposed at a position on the cylinder block attachment surface side in the second coolant passage. Thus, the coolant temperature sensor detects the temperature of the coolant flowing through the space on the cylinder block attachment surface side in the second coolant passage, that is, the temperature of the coolant discharged from the first water jacket. As a result, the coolant temperature that reflects the engine temperature is appropriately detected.

In the cooling structure according to the above aspect: in a state where the internal combustion engine is mounted in a vehicle, the coolant outlet of the second water jacket may be located at a position on an upper side in a vertical direction in the first coolant passage; and in the state where the internal combustion engine is mounted in the vehicle, the temperature sensing portion may be located at a position on a lower side in the vertical direction in the second coolant passage.

In the foregoing configuration, the coolant outlet of the second water jacket is located at a position on the upper side in the vertical direction in the first coolant passage. Thus, the major portion of the coolant discharged from the second water jacket flows more reliably through a space on the upper side in the vertical direction in the first coolant passage and a space on the upper side in the vertical direction in the second coolant passage located downstream of the joining portion. The temperature of the coolant discharged from the second water jacket is higher than the temperature of the coolant discharged from the first water jacket, and the density of the coolant discharged from the second water jacket is lower than the density of the coolant discharged from the first water jacket. Thus, the coolant discharged from the second water jacket is collected more reliably in the space on the upper side in the vertical direction in the first coolant passage and in the space on the upper side in the vertical direction in the second coolant passage. As a result, it is possible to appropriately maintain the state where the major portion of the coolant discharged from the second water jacket flows through the space on the upper side in the vertical direction in the first coolant passage and the space on the upper side in the vertical direction in the second coolant passage. The major portion of the coolant discharged from the second water jacket flows through the space on the upper side in the vertical direction in the first coolant passage and the space on the upper side in the vertical direction in the second coolant passage. Thus, in the first coolant passage and the second coolant passage, the mixing of the coolant discharged from the second water jacket and the coolant discharged from the first water jacket is inhibited. The coolant discharged from the first water jacket flows through a space on the lower side in the vertical direction with respect to the coolant discharged from the second water jacket (the space through which the coolant flows is vertically lower than the space through which the coolant flows), in the first coolant passage and the second coolant passage.

With the foregoing configuration, the coolant discharged from the first water jacket flows through the space on the lower side in the vertical direction with respect to the coolant discharged from the second water jacket while the mixing of the coolant discharged from the first water jacket and the coolant discharged from the second water jacket is inhibited in the second coolant passage. The temperature sensing portion of the coolant temperature sensor is disposed at a position on the lower side in the vertical direction in the second coolant passage, and thus the coolant temperature sensor detects the temperature of the coolant flowing through the space on the lower side in the vertical direction in the second coolant passage, that is, the temperature of the coolant discharged from the first water jacket. As a result, the coolant temperature that reflects the engine temperature is more appropriately detected.

In the cooling structure according to the above aspect, the first coolant passage and the second coolant passage may be arranged so as to be linearly continuous with each other. With this configuration, it is possible to reduce variations in the flow direction of the coolant due to the directions in which the coolant passages are formed. Thus, the coolant enters the second coolant passage with the major portion of the coolant discharged from the second water jacket kept flowing through the space on the upper side in the first coolant passage.

In the cooling structure according to the above aspect, the second coolant passage may be defined in a member prepared separately from the cylinder head, and the member that defines the second coolant passage may be made of a resin material. With this configuration, it is possible to easily form the coolant passage provided with the temperature sensing portion.

In the cooling structure according to the above aspect, a volume of the first water jacket may be larger than a volume of the second water jacket. With this configuration, the ratio of the amount of coolant introduced from the first water jacket to the amount of coolant flowing through the second coolant passage increases. Thus, even when the temperature of the coolant is detected at a position downstream of the joining portion, it is possible to accurately detect the temperature of the coolant discharged from the first water jacket.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
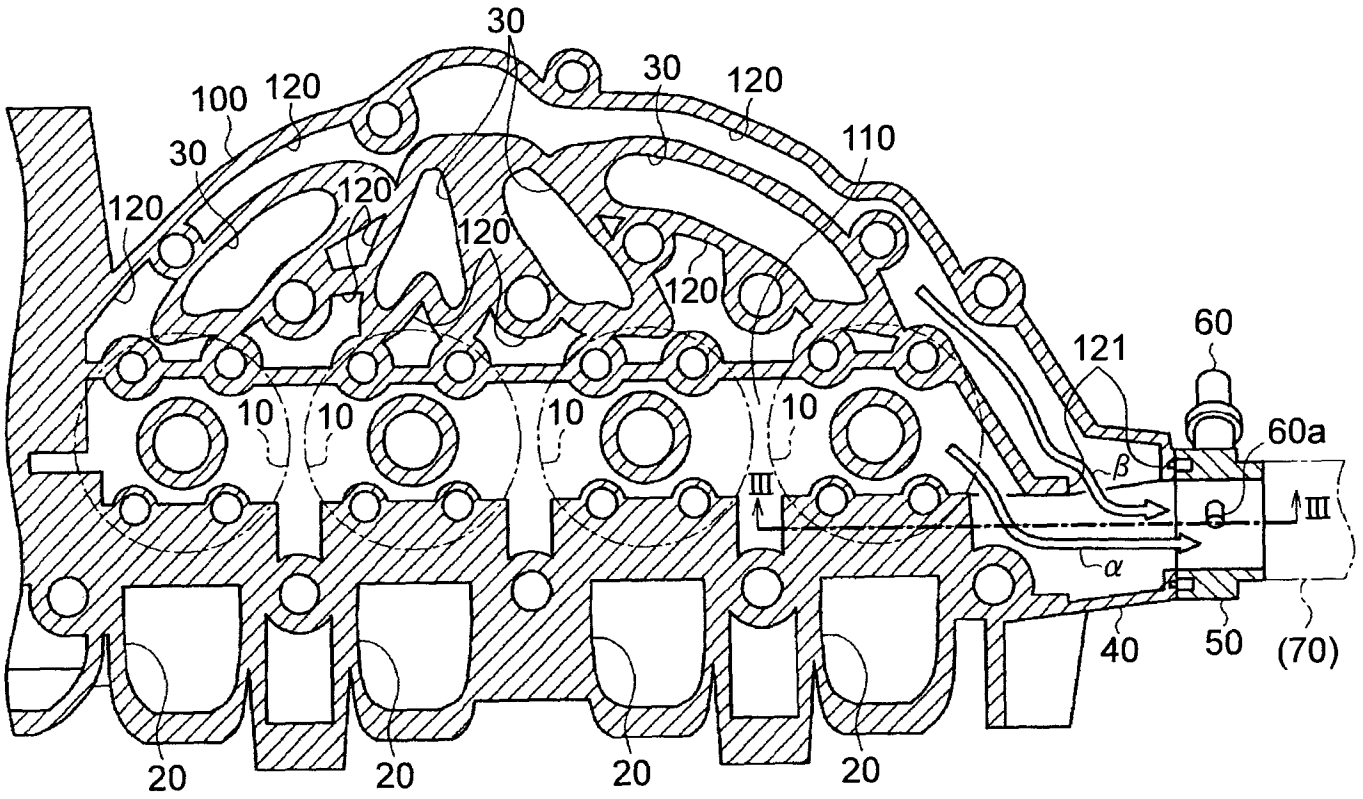
FIG. 1 is a sectional view of a cylinder head in a cooling structure of an internal combustion engine according to an embodiment of the invention, the sectional view taken along the longitudinal direction of the cylinder head.

Hereinafter, a cooling structure of an internal combustion engine according to an embodiment of the invention will be described with reference to FIG. 1 to FIG. 5. As illustrated in FIG. 1, a cylinder head 100 in the present embodiment has a plurality of combustion chambers 10. Further, the cylinder head 100 has a plurality of intake ports 20 from which intake air is introduced into the combustion chambers 10, and a plurality of exhaust ports into which exhaust gas is discharged from the combustion chambers 10. An exhaust manifold 30, in which the exhaust ports join together, is formed integrally with the cylinder head 100.

A first water jacket 110 through which an engine coolant for cooling the combustion chambers 10 flows is defined within the cylinder head 100. The first water jacket 110 extends in the longitudinal direction of the cylinder head 100. Further, a second water jacket 120 is defined within the cylinder head 100. The second water jacket 120 is disposed such that the engine coolant flows around the exhaust manifold 30. The exhaust manifold 30 is cooled by the coolant flowing through the second water jacket 120. The volume of the first water jacket 110 is larger than the volume of the second water jacket 120. Because the first water jacket 110 and the second water jacket 120 have known configurations, the details thereof will be omitted from the following description.

The cylinder head 100 has a joining portion 40 in which the coolant discharged from the first water jacket 110 and the coolant discharged from the second water jacket 120 join together. The joining portion 40 is disposed on one side of the cylinder head 100 in the direction along which the combustion chambers 10 are aligned. A water outlet 50 is connected to the downstream side portion of the joining portion 40. The water outlet 50 is made of a resin material, and prepared separately from the cylinder head 100. A coolant pipe 70 is connected to the downstream side portion of the water outlet 50.

Figure 3:
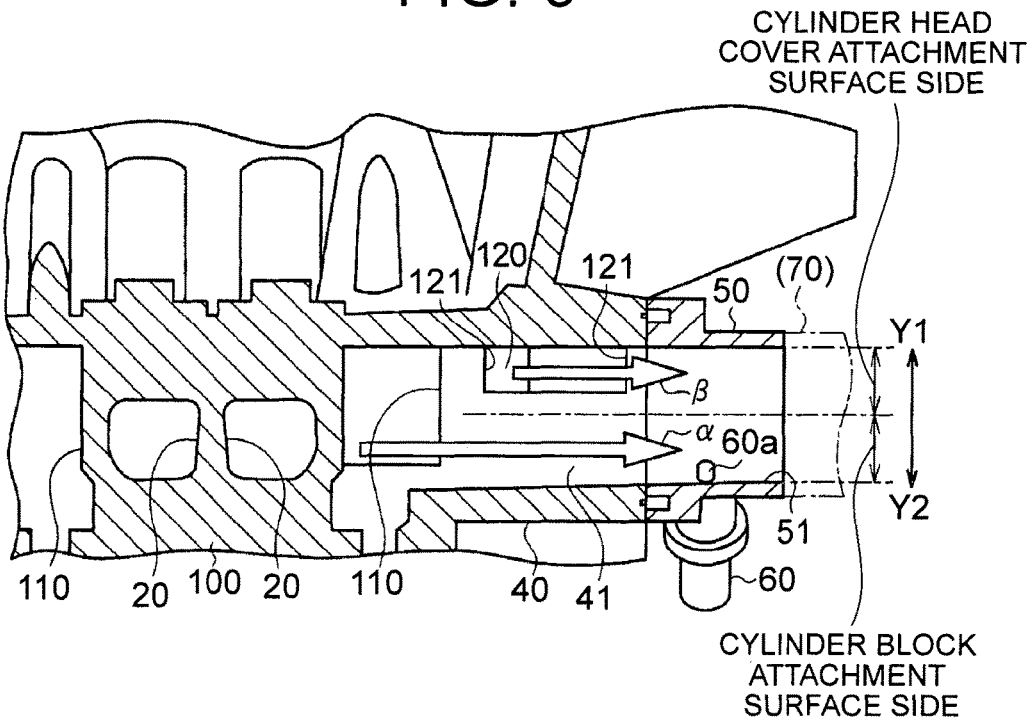
FIG. 3 is a sectional view taken along the line in FIG. 1.
Figure 4:
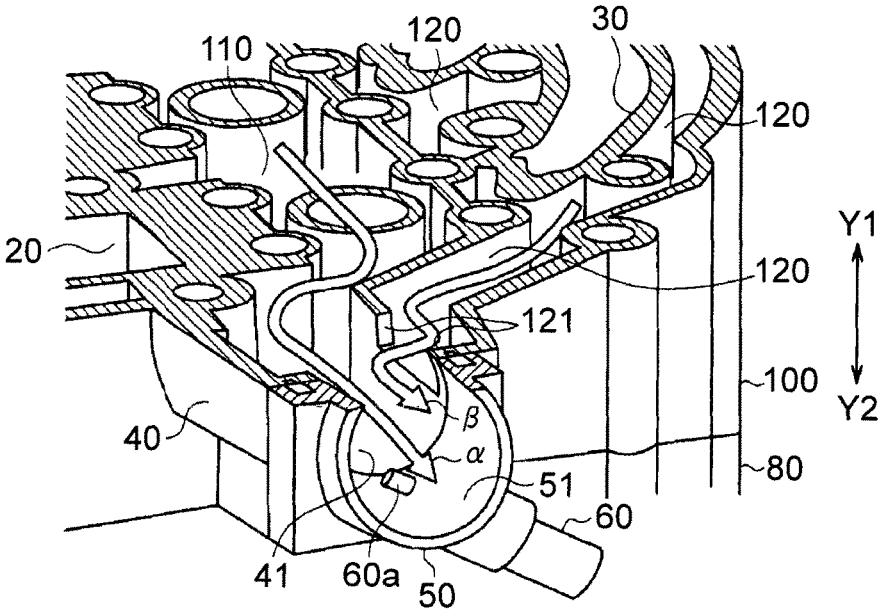
FIG. 4 is a perspective view illustrating the sectional structure of a joining portion of the cylinder head and its vicinity in the embodiment.
Figure 5:
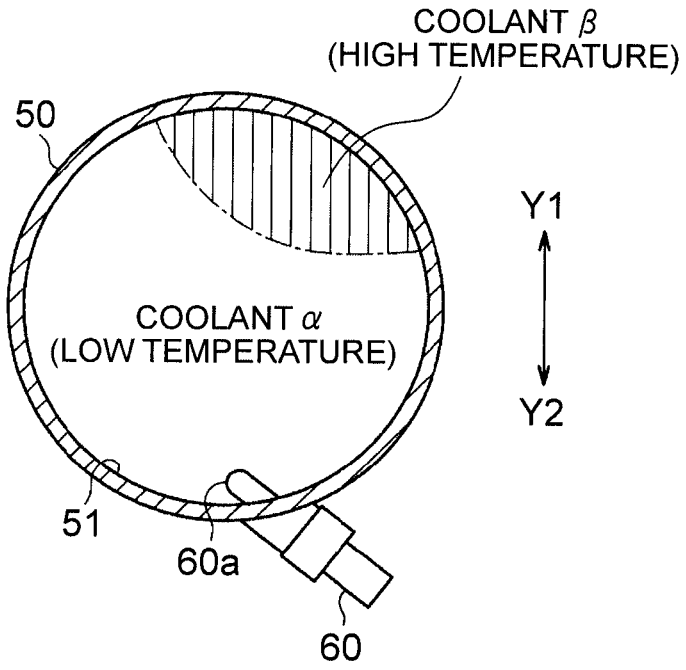
FIG. 5 is a view illustrating the temperature distribution of a coolant in the radial direction in a water outlet in the embodiment.

As illustrated in FIG. 3 to FIG. 5, a second coolant passage 51 is defined inside the water outlet 50. The coolant discharged from the joining portion 40 flows into the second coolant passage 51. A temperature sensing portion 60*a* provided at the distal end of a coolant temperature sensor 60 is disposed in the second coolant passage 51. The temperature sensing portion 60*a* detects the temperature of the coolant discharged from the cylinder head 100.

Figure 2:
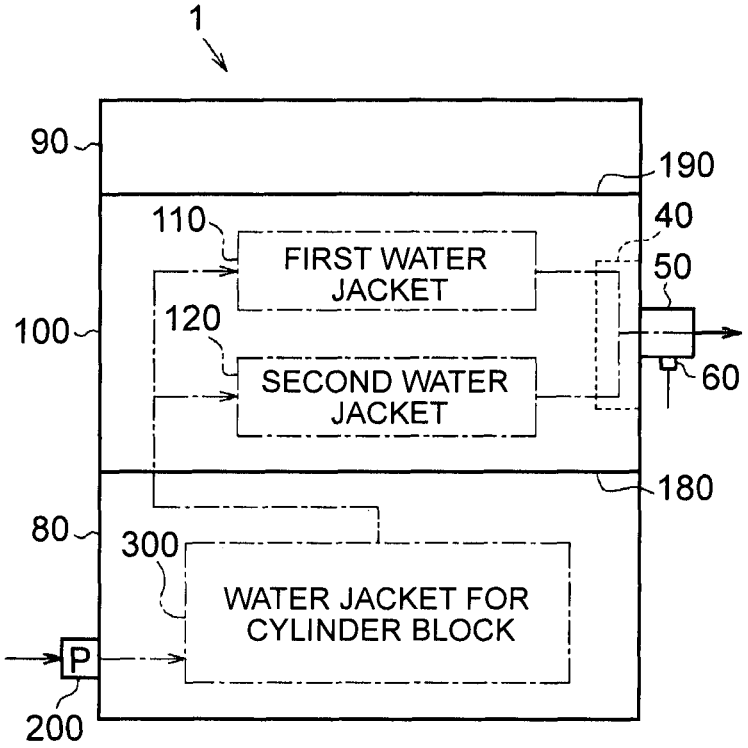
FIG. 2 is a schematic diagram illustrating the structure of the internal combustion engine and a cooling system of the internal combustion engine.

FIG. 2 illustrates the structure of the internal combustion engine 1 including the cylinder head 100 and part of a cooling system of the internal combustion engine 1. The cylinder head 100 is disposed between a cylinder block 80 and a cylinder head cover 90.

The cylinder head 100 has a cylinder block attachment surface 180 to which the cylinder block 80 is attached, and a cylinder head cover attachment surface 190 to which the cylinder head cover 90 is attached.

The cylinder block 80 of the internal combustion engine 1 has a water jacket 300 through which a coolant for cooling the cylinder block 80 flows. The coolant transferred from a water pump 200 flows into the water jacket 300 for the cylinder block 80.

The coolant introduced into the water jacket 300 for the cylinder block 80 cools the cylinder block 80 of the internal combustion engine 1, and then flows into the first water jacket 110 and the second water jacket 120 of the cylinder head 100.

The coolant introduced into the first water jacket 110 cools the combustion chambers 10, and then flows into the joining portion 40. The coolant introduced into the second water jacket 120 cools the exhaust manifold 30, and then flows into the joining portion 40. The coolant introduced into the joining portion 40 flows out through the water outlet 50 provided with the coolant temperature sensor 60.

FIG. 3 illustrates a sectional structure of the joining portion 40 and its vicinity, taken along the coolant flow direction. An arrow Y1 in FIG. 3 indicates the side on which the cylinder head cover attachment surface 190 of the cylinder head 100 is located, and an arrow Y2 in FIG. 3 indicates the side on which the cylinder block attachment surface 180 of the cylinder head 100 is located.

FIG. 4 is a perspective view illustrating the sectional structure of the joining portion 40 and its vicinity. As illustrated in FIG. 3 and FIG. 4, a coolant α, which cools the combustion chambers 10 and then flows out of the first water jacket 110, and a coolant β, which cools the exhaust manifold 30 and then flows out of the second water jacket 120, flow into a first coolant passage 41 defined by the inner wall of the joining portion 40.

As illustrated in FIG. 3 and FIG. 4, a coolant outlet 121 of the second water jacket 120 is disposed at a position on the cylinder head cover attachment surface 190-side in the first coolant passage 41. Through the coolant outlet 121, the coolant β flows into the joining portion 40 from the second water jacket 120. The temperature sensing portion 60*a* is disposed at a position on the cylinder block attachment surface 180-side in the second coolant passage 51. More specifically, in a state where the internal combustion engine 1 is mounted in a vehicle, the coolant outlet 121 of the second water jacket 120 is located at a position on the upper side in the vertical direction in the first coolant passage 41, and the temperature sensing portion 60*a* is located at a position on the lower side in the vertical direction in the second coolant passage 51.

Detailed description will be provided on "cylinder head cover attachment surface 190-side" and "cylinder block attachment surface 180-side" described above. When a section of each of the first coolant passage 41 and the second coolant passage 51 taken along the flow direction is divided into two regions (divided into two equal regions), that is, a region on the side on which the cylinder head cover 90 is disposed and a region on the side on which the cylinder block 80 is disposed, the region on the side on which the cylinder head cover 90 is disposed is referred to as the "cylinder head cover attachment surface 190-side", and the region on the side on which the cylinder block 80 is disposed is referred to as the "cylinder block attachment surface 180-side".

Detailed description will be provided on "upper side in the vertical direction" and "lower side in the vertical direction" described above. When a section of each of the first coolant passage 41 and the second coolant passage 51 taken along the flow direction is divided into two regions (divided into two equal regions), the region on the upper side in the vertical direction is referred to as the "upper side in the vertical direction" and the region on the lower side in the vertical direction is referred to as the "lower side in the vertical direction".

The first coolant passage 41 and the second coolant passage 51 are arranged so as to be linearly continuous with each other. Next, with reference to FIG. 5, the advantageous effects produced by the cooling structure according to the present embodiment will be described.

An arrow Y1 in FIG. 5 indicates the side on which the cylinder head cover attachment surface 190 of the cylinder head 100 is located, and an arrow Y2 in FIG. 5 indicates the side on which the cylinder block attachment surface 180 of the cylinder head 100 is located.

The coolant α discharged from the first water jacket 110 and the coolant β discharged from the second water jacket 120 flow into the second coolant passage 51 in which the temperature sensing portion 60*a* is disposed, through the joining portion 40.

As illustrated in FIG. 3 or FIG. 4, the coolant outlet 121 of the second water jacket 120 is located at a position on the cylinder head cover attachment surface 190-side in the first coolant passage 41. Thus, the major portion of the coolant β discharged from the second water jacket 120 flows more reliably through a space on the cylinder head cover attachment surface 190-side in the first coolant passage 41 and a space on the cylinder head cover attachment surface 190-side in the second coolant passage 51 located downstream of the joining portion 40 as illustrated in FIG. 5. As a result, in the first coolant passage 41 and the second coolant passage 51, mixing of the coolant β discharged from the second water jacket 120 and the coolant α discharged from the first water jacket 110 is inhibited. The mixing of the coolants is inhibited as described above, and thus the major portion of the coolant α discharged from the first water jacket 110 flows through a space on the cylinder block attachment surface 180-side in the first coolant passage 41 and a space on the cylinder block attachment surface 180-side in the second coolant passage 51. Note that, the cylinder block attachment surface 180-side is located on the opposite side of the central axis of each of the first coolant passage 41 and the second coolant passage 51 from the cylinder head cover attachment surface 190-side.

The temperature sensing portion 60*a* of the coolant temperature sensor 60 is disposed at a position on the cylinder block attachment surface 180-side in the second coolant passage 51. Thus, the coolant temperature sensor 60 detects the temperature of the coolant flowing through the space on the cylinder block attachment surface 180-side in the second coolant passage 51, that is, the temperature of the coolant α discharged from the first water jacket 110. As a result, the coolant temperature that reflects the engine temperature is appropriately detected.

In the present embodiment, the coolant outlet 121 of the second water jacket 120 is located at a position on the upper side in the vertical direction in the first coolant passage 41. Thus, the major portion of the coolant β discharged from the second water jacket 120 flows more reliably through a space on the upper side in the vertical direction in the first coolant passage 41 and a space on the upper side in the vertical direction in the second coolant passage 51 located downstream of the joining portion 40.

The temperature of the coolant β discharged from the second water jacket 120 is higher than the temperature of the coolant α discharged from the first water jacket 110, and the density of the coolant β discharged from the second water jacket 120 is lower than the density of the coolant α discharged from the first water jacket 110. Thus, the coolant β discharged from the second water jacket 120 is collected more reliably in the space on the upper side in the vertical direction in the first coolant passage 41 and in the space on the upper side in the vertical direction in the second coolant passage 51. As a result, it is possible to appropriately maintain the state where the major portion of the coolant β discharged from the second water jacket 120 flows through the space on the upper side in the vertical direction in the first coolant passage 41 and the space on the upper side in the vertical direction in the second coolant passage 51.

The major portion of the coolant β discharged from the second water jacket 120 flows through the space on the upper side in the vertical direction in the first coolant passage 41 and the space on the upper side in the vertical direction in the second coolant passage 51. Thus, in the first coolant passage 41 and the second coolant passage 51, the mixing of the coolant β discharged from the second water jacket 120 and the coolant α discharged from the first water jacket 110 is inhibited. As illustrated in FIG. 5, the coolant α discharged from the first water jacket 110 flows through a space on the lower side in the vertical direction with respect to the coolant β discharged from the second water jacket 120 (the space through which the coolant α flows is vertically lower than the space through which the coolant β flows), in the first coolant passage 41 and the second coolant passage 51.

In this way, the coolant α discharged from the first water jacket 110 flows through the space on the lower side in the vertical direction with respect to the coolant β discharged from the second water jacket 120 while the mixing of the coolant α discharged from the first water jacket 110 and the coolant β discharged from the second water jacket 120 is inhibited in the second coolant passage 51. The temperature sensing portion 60*a* of the coolant temperature sensor 60 is disposed at a position on the lower side in the vertical direction in the second coolant passage 51, and thus the coolant temperature sensor 60 detects the temperature of the coolant flowing through the space on the lower side in the vertical direction in the second coolant passage 51, that is, the temperature of the coolant α discharged from the first water jacket 110. As a result, the coolant temperature that reflects the engine temperature is more appropriately detected.

Because the first coolant passage 41 and the second coolant passage 51 are arranged so as to be linearly continuous with each other, it is possible to reduce variations in the flow direction of the coolant due to the directions in which the coolant passages are formed (or the direction of connection between the first coolant passage 41 and the second coolant passage 51). Thus, the coolant β enters the second coolant passage 51 with the major portion of the coolant β discharged from the second water jacket 120 kept flowing through the space on the upper side in the first coolant passage 41. As a result, the above-described advantageous effects are more reliably obtained.

If the temperature sensing portion 60*a* of the coolant temperature sensor 60 is provided in the first water jacket 110, it is possible to detect the coolant temperature that reflects the engine temperature. However, in this case, it is necessary to provide the coolant temperature sensor 60 inside the cylinder head 100 instead of providing it on the outer side of the cylinder head 100, but it is difficult to provide the coolant temperature sensor 60 inside the cylinder head 100. In this regard, in the present embodiment, as illustrated in FIG. 1, the joining portion 40 is disposed on one side of the cylinder head 100 in the direction along which the combustion chambers 10 are aligned, and the coolant temperature sensor 60 is provided in the second coolant passage 51 located downstream of the joining portion 40. That is, the coolant temperature sensor 60 is provided on the outer side of the cylinder head 100. Thus, even with this arrangement of the sensor, it is possible to detect the coolant temperature that reflects the engine temperature.

The water outlet 50 that defines the second coolant passage 51 is made of a resin material, and prepared separately from the cylinder head 100. Thus, it is possible to easily form the second coolant passage 51 provided with the temperature sensing portion 60*a*.

The volume of the first water jacket 110 is larger than the volume of the second water jacket 120. Thus, the ratio of the amount of coolant introduced from the first water jacket 110 to the amount of coolant flowing through the second coolant passage 51 of the water outlet 50 increases. Thus, even when the temperature of the coolant is detected at a position downstream of the joining portion 40, it is possible to accurately detect the temperature of the coolant α discharged from the first water jacket 110.

As described above, according to the present embodiment, the following advantageous effects are obtained. (1) The second coolant passage 51 provided with the temperature sensing portion 60*a* of the coolant temperature sensor 60 is disposed downstream of the joining portion 40. The coolant outlet 121 of the second water jacket 120 defined in the first coolant passage 41 is located at a position on the cylinder head cover attachment surface 190-side in the first coolant passage 41. The temperature sensing portion 60*a* of the coolant temperature sensor 60 is located at a position on the cylinder block attachment surface 180-side in the second coolant passage 51. With this configuration, it is possible to appropriately detect the coolant temperature that reflects the engine temperature.

(2) The coolant outlet 121 of the second water jacket 120 is located at a position on the upper side in the vertical direction in the first coolant passage 41. The temperature sensing portion 60*a* of the coolant temperature sensor 60 is located at a position on the lower side in the vertical direction in the second coolant passage 51. Thus, it is possible to more appropriately detect the coolant temperature that reflects the engine temperature.

(3) The first coolant passage 41 and the second coolant passage 51 are arranged so as to be linearly continuous with each other. Thus, the coolant β enters the second coolant passage 51 with the major portion of the coolant β discharged from the second water jacket 120 kept flowing through the space on the upper side in the first coolant passage 41.

(4) Even when the coolant temperature sensor 60 is provided on the outer side of the cylinder head 100, it is possible to detect the coolant temperature that reflects the engine temperature. (5) The water outlet 50 that defines the second coolant passage 51 is made of a resin material, and prepared separately from the cylinder head 100. Thus, it is possible to easily form the second coolant passage 51 provided with the temperature sensing portion 60*a*.

(6) The volume of the first water jacket 110 is larger than the volume of the second water jacket 120. Thus, even when the temperature of the coolant is detected at a position downstream of the joining portion 40, it is possible to more accurately detect the temperature of the coolant α discharged from the first water jacket 110.

The foregoing embodiment may be modified as follows. In the foregoing embodiment, the coolant outlet 121 of the second water jacket 120 is located at a position on the upper side in the vertical direction in the first coolant passage 41, and the temperature sensing portion 60*a* of the coolant temperature sensor 60 is located at a position on the lower side in the vertical direction in the second coolant passage 51. However, the coolant outlet 121 need not be located at a position on the upper side in the vertical direction, and the temperature sensing portion 60*a* need not be located at a position on the lower side in the vertical direction. In this case as well, it is possible to obtain at least the advantageous effects except the advantageous effect (2) described above.

Figure 6:
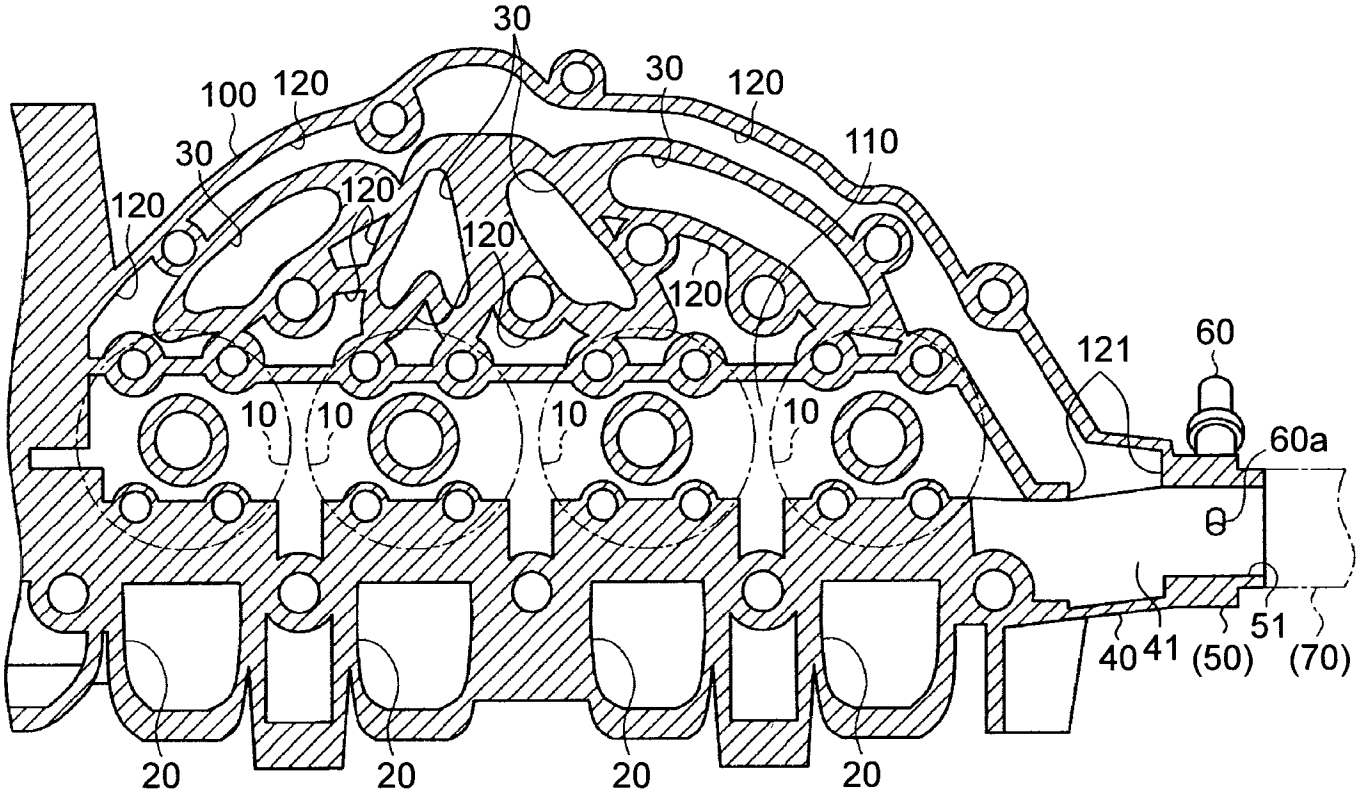
FIG. 6 is a sectional view of a cylinder head according to a modified example of the embodiment of the invention, the sectional view taken along the longitudinal direction of the cylinder head.

In the foregoing embodiment, the second coolant passage 51 provided with the temperature sensing portion 60*a* is defined in the water outlet 50. In the foregoing embodiment, the water outlet 50 is connected to the downstream side portion of the joining portion 40. That is, the water outlet 50 that defines the second coolant passage 51 and the cylinder head 100 are members prepared separately from each other. Alternatively, as illustrated in FIG. 6, the water outlet 50 may be formed integrally with the cylinder head 100, so that the second coolant passage 51 is formed integrally with the cylinder head 100.

The first coolant passage 41 and the second coolant passage 51 are arranged so as to be linearly continuous with each other. However, the first coolant passage 41 and the second coolant passage 51 may be arranged in another way. In this case as well, it is possible to obtain at least the advantageous effects except the advantageous effect (3) described above.

The volume of the first water jacket 110 may be equal to the volume of the second water jacket 120, or the volume of the first water jacket 110 may be smaller than the volume of the second water jacket 120. In this case as well, it is possible to obtain the advantageous effects except the advantageous effect (6) described above.

The invention claimed is:

1. A cooling structure of an internal combustion engine, the cooling structure comprising:

a cylinder head; and a coolant temperature sensor including a temperature sensing portion, wherein the cylinder head includes a cylinder block attachment surface and a cylinder head cover attachment surface, the cylinder head includes an exhaust manifold, the cylinder head includes a first water jacket through which a coolant to cool a combustion chamber flows and a second water jacket through which a coolant to cool the exhaust manifold flows, the first water jacket and the second water jacket are defined within the cylinder head, the cylinder head includes a joining portion in which the coolant discharged from a most downstream coolant outlet of the first water jacket and the coolant discharged from a most downstream coolant outlet of the second water jacket join together, the joining portion includes a first coolant passage, a second coolant passage is disposed at a position downstream of the joining portion, the temperature sensing portion is disposed in the second coolant passage, the most downstream coolant outlet of the second water jacket is defined in the first coolant passage, and the most downstream coolant outlet of the second water jacket is located at a position on a cylinder head cover attachment surface side in the first coolant passage, and the temperature sensing portion is located at a position on a cylinder block attachment surface side in the second coolant passage.

2. The cooling structure according to claim 1, wherein:

in a state where the internal combustion engine is mounted in a vehicle, the most downstream coolant outlet of the second water jacket is located at a position on an upper side in a vertical direction in the first coolant passage; and in the state where the internal combustion engine is mounted in the vehicle, the temperature sensing portion is located at a position on a lower side in the vertical direction in the second coolant passage.

3. The cooling structure according to claim 1, wherein the first coolant passage and the second coolant passage are arranged so as to be linearly continuous with each other.

4. The cooling structure according to claim 1, wherein:

the second coolant passage is defined in a structure prepared separately from the cylinder head; and the structure that defines the second coolant passage is made of a resin material.

5. The cooling structure according to claim 1, wherein a volume of the first water jacket is larger than a volume of the second water jacket.

* * * * *